US009382103B2

(12) United States Patent
Seow

(10) Patent No.: US 9,382,103 B2
(45) Date of Patent: Jul. 5, 2016

(54) HOIST

(76) Inventor: Tiong Bin Seow, Singapore (SG)

( * ) Notice: Subject to any disclaimer, the term of this patent is extended or adjusted under 35 U.S.C. 154(b) by 447 days.

(21) Appl. No.: 12/735,573

(22) PCT Filed: Jan. 30, 2009

(86) PCT No.: PCT/SG2009/000038

§ 371 (c)(1),
(2), (4) Date: Jul. 28, 2010

(87) PCT Pub. No.: WO2009/096906

PCT Pub. Date: Aug. 6, 2009

(65) Prior Publication Data

US 2010/0314594 A1 Dec. 16, 2010

(30) Foreign Application Priority Data

Jan. 30, 2008 (SG) ..... 200800847-6

(51) Int. Cl.

| | |
|---|---|
| ***B66D 1/38*** | (2006.01) |
| ***B66D 1/36*** | (2006.01) |
| ***B66D 1/74*** | (2006.01) |
| *B65H 57/14* | (2006.01) |
| *B65H 59/22* | (2006.01) |

(52) U.S. Cl.
CPC .. *B66D 1/36* (2013.01); *B66D 1/38* (2013.01); *B66D 1/7447* (2013.01); *B65H 57/14* (2013.01); *B65H 59/22* (2013.01)

(58) Field of Classification Search
CPC ..... B66D 1/34; B66D 1/36; B66D 1/38; B66D 1/7447; B65H 57/14; B65H 59/22; B65H 2404/14
USPC ..... 254/383, 371, 373; 242/419.4, 419.5, 242/149, 151, 397, 397.5
See application file for complete search history.

(56) References Cited

U.S. PATENT DOCUMENTS

| | | | | | |
|---|---|---|---|---|---|
| 1,782,358 | A | * | 11/1930 | Lang | 242/483 |
| 1,973,446 | A | * | 9/1934 | Resenquist | 242/483 |
| 2,926,867 | A | * | 3/1960 | Nardone | 242/397.3 |
| 3,231,240 | A | * | 1/1966 | Naito | 254/333 |
| 3,717,325 | A | * | 2/1973 | Peterson | 254/382 |
| 3,721,426 | A | * | 3/1973 | Kaufer | 254/333 |
| 3,794,233 | A | * | 2/1974 | Dykmans | 226/183 |
| 3,836,123 | A | * | 9/1974 | Bausenbach et al. | 242/157.1 |
| 3,843,094 | A | * | 10/1974 | Watts | 254/333 |
| 3,927,867 | A | * | 12/1975 | Herchenroder | 254/313 |

(Continued)

FOREIGN PATENT DOCUMENTS

| | | |
|---|---|---|
| CN | 2548982 Y | 5/2003 |
| CN | 2550335 Y | 5/2003 |

(Continued)

*Primary Examiner* — Emmanuel M Marcelo
*Assistant Examiner* — Justin Stefanon
(74) *Attorney, Agent, or Firm* — Axis Intellectual Capital Pte Ltd

(57) ABSTRACT

Hoists for hoisting loads by means of a cable are in existence for a long period. There are various types of hoists, which include winches and capstans. Generally, the principle of operation of a hoist is based on the cable being driven by adherence of the cable to the drum of the hoist. A hoist is described according to an embodiment of the present invention. The hoist comprises a drum, a plurality of guides, a guide support and a biasing device for displacing a portion of a cable away from the guide when the drum is rotationally displaced to thereby hoist a load.

20 Claims, 5 Drawing Sheets

(56) References Cited

U.S. PATENT DOCUMENTS

| | | | | | |
|---|---|---|---|---|---|
| 3,944,185 | A | * | 3/1976 | Evans | 254/378 |
| 3,966,170 | A | * | 6/1976 | McKenna | 254/280 |
| 4,057,202 | A | * | 11/1977 | Carr, Jr. | 242/157 R |
| 4,139,178 | A | * | 2/1979 | Hippach | 254/267 |
| 4,611,787 | A | * | 9/1986 | May et al. | 254/267 |
| 4,620,615 | A | * | 11/1986 | Morris et al. | 187/264 |
| 4,634,078 | A | * | 1/1987 | Kaufmann et al. | 242/483 |
| 4,634,102 | A | * | 1/1987 | Appling et al. | 254/278 |
| 4,706,940 | A | * | 11/1987 | Harig | 254/333 |
| 4,721,285 | A | * | 1/1988 | McMichael | 254/333 |
| 4,795,108 | A | * | 1/1989 | Appling | 242/157.1 |
| 4,827,752 | A | * | 5/1989 | Alcock et al. | 72/289 |
| 4,909,482 | A | | 3/1990 | Hofmann et al. | |
| 4,921,219 | A | * | 5/1990 | Ottemann et al. | 254/284 |
| 4,953,829 | A | * | 9/1990 | Knaack et al. | 254/333 |
| 5,002,238 | A | * | 3/1991 | Inhofer et al. | 242/157.1 |
| 5,129,626 | A | * | 7/1992 | Koludzki | 254/333 |
| 5,482,219 | A | * | 1/1996 | Tcholakov | 242/397.3 |
| 5,626,081 | A | * | 5/1997 | Kuryu | 104/197 |
| 6,095,500 | A | | 8/2000 | McVaugh | |
| 6,435,447 | B1 | * | 8/2002 | Coats et al. | 242/483 |
| 7,448,597 | B2 | * | 11/2008 | Jacobson et al. | 254/274 |
| 7,527,243 | B2 | * | 5/2009 | Blasek | 254/333 |
| 8,720,811 | B2 | * | 5/2014 | Zink | 242/397.2 |
| 2006/0207829 | A1 | | 9/2006 | Mauthner | |

FOREIGN PATENT DOCUMENTS

| | | | |
|---|---|---|---|
| CN | 2771168 | Y | 4/2006 |
| JP | 05-338994 | A | 12/1993 |
| JP | 10-036084 | A | 2/1998 |

* cited by examiner

HOIST

FIELD OF INVENTION

The invention relates generally to load hoisting, and more particularly to a hoist for hoisting a load by means of a cable.

BACKGROUND

Hoists for hoisting loads by means of a cable have long existed. Generally, the principle of operation of a hoist is based on the cable being driven by adherence of the cable to the drum of the hoist. The drum holds the cable by friction, which operates as the principal power means for drawing in the cable for winding around the drum. As tension that is applied to the cable increases, the cable stretches and its linear speed decreases accordingly.

There are various types of hoists, which include winches and capstans. A winch is used to wind up a cable in which one end of the cable is fixed and the cable is generally stored on the drum of the winch. Besides industrial applications, for example on lifting cranes, winches are also used on vehicles for towing cars and boats. Winches are widely used for hoisting loads as they provide mechanical advantage to users. However, a drawback of using a winch to hoist a load is that sufficient tension must be constantly maintained on the turns for the cable to be suitably wound and stored on the drum. Typically, a guide mechanism is used for progressively guiding the cable across the length of the drum as the cable is being wound onto the drum.

Capstans are similar to winches with the exception that the cable is not stored on the drums. Hence, capstans do not have the problem of constantly maintaining sufficient tension on the turns for the cable to be suitably wound and stored on the drums. Capstans are rotating machines used to apply force to another element and are typically used on board ships and on dock walls for heaving or veering ropes, cables and hawsers. When a capstan is in operation, only a portion of the cable is wound around the drum of the capstan. A load can be attached to one of the free ends for the capstan to hoist the load. However, as the cable is driven by adherence of the cable to the drum of the capstan, sufficient frictional force is needed between the cable and the drum for operation of the capstan.

Japanese Patent Application Number 20040163404 to Fumiaki discloses an endless type winch having a configuration capable of towing and driving a winch without winding a rope by utilising a part around a driving mechanism of an existing winch as it is. The endless type winch comprises a winding drum having a rope channel at the outer periphery, a pair of rope gripping guide sheaves and a supporting frame. The pair of rope gripping guide sheaves is arranged in positions where the rope winds around the rope channel of the winding drum so as to increase contact frictional force of the rope for the rope channel. However, as the rope elastically contracts due to its tension diminishing in passing through the endless type winch, the length of the rope changes continuously. The rope slides against the rope channel of the winding drum for accommodating the changing rope length, which results in wear and tear of the rope. Further, the sliding of the rope against the rope channel increases slippage of the rope between the drum and the rope gripping guide sheave.

Therefore, there is a need for a hoist, which addresses at least one of the aforementioned problems.

SUMMARY

The present embodiment of the invention disclosed herein provides a hoist for hoisting a load by means of a cable.

In accordance with a first aspect of the invention, a hoist comprising a drum, a biasing mechanism and at least one guide is disclosed. The drum comprises a drum surface for supporting a cable thereon and the cable has an anchored end. The at least one guide is coupled to the biasing mechanism and the biasing mechanism is for biasing the at least one guide towards the drum for clasping at least one portion of the cable between the at least one guide and the drum. This is to substantially adhere the clasped at least one portion of the cable to the drum surface. When a portion of the cable extending between the anchored end and the drum is in tension, slippage between the drum surface and the clasped at least one portion of the cable is substantially impeded and the drum is rotationally displaceable for displacing the clasped at least one portion of the cable away from the at least one guide.

In accordance with a second aspect of the invention, a hoist comprising a drum, a plurality of guides, a guide support and a biasing device is disclosed. The drum comprises a drum surface for supporting a cable thereon and the cable has an anchored end. The guide support is for inter-coupling the plurality of guides. The biasing device cooperates with the guide support for biasing the plurality of guides towards the drum for clasping at least one portion of the cable between the plurality of guides and the drum. This is to substantially adhere the clasped at least one portion of the cable to the drum surface. When a portion of the cable extending between the anchored end and the drum is in tension, slippage between the drum surface and the clasped at least one portion of the cable is substantially impeded and the drum is rotationally displaceable for displacing the clasped at least one portion of the cable away from the plurality of guides.

In accordance with a third aspect of the invention, a cable adherence apparatus comprising a plurality of guides, a guide support and a biasing device is disclosed. The guide support is for inter-coupling the plurality of guides and is coupled to the biasing device. The biasing device is couplable to a drum assembly that comprises a drum. The drum has a drum surface for supporting a cable thereon and the cable has an anchored end. The biasing device is for cooperating with the guide support for biasing the plurality of guides towards the drum for clasping at least one portion of the cable between the plurality of guides and the drum. This is to substantially adhere the clasped at least one portion of the cable to the drum surface. When a portion of the cable extending between the anchored end and the drum is in tension, slippage between the drum surface and the clasped at least one portion of the cable is substantially impeded and the drum is rotationally displaceable for displacing the clasped at least one portion of the cable away from the plurality of guides.

In accordance with a fourth aspect of the invention, a hoist comprising a drum and a plurality of guide members is disclosed. The drum has a drum surface for supporting a cable thereon and the cable has an anchored end. The plurality of guide members are one of biasable toward and displaceable away from the drum surface. The plurality of guide members comprise a first guide member and second guide members. The first guide member guides the cable to the drum and the second guide members clasp at least one portion of the cable between the second guide members and the drum. Guidance of the cable via the first guide member biases the second guide members toward the drum surface to substantially adhere the clasped at least one portion of the cable to the drum surface. When a portion of the cable extending between the anchored end and the drum is in tension, slippage between the drum surface and the clasped at least one portion of the cable is substantially impeded and the drum is rotationally displaceable for displacing the clasped at least one portion of the cable away from the plurality of guide members.

In accordance with a fifth aspect of the invention, a hoist comprising a drum, a plurality of guide members and a biasing device is disclosed. The drum has a drum surface for supporting a cable thereon and the cable has an anchored end. The plurality of guide members are one of biasable toward and displaceable away from the drum surface. The plurality of guide members comprise a first guide member and second guide members. The first guide member guides the cable to the drum and the second guide members clasp at least one portion of the cable between the second guide members and the drum. The biasing device cooperates with the plurality of guide members whereby biasing of the second guide members toward the drum surface releases tension in the biasing device and the displacement of the second guide members away from the drum surface producing tension in the biasing device. When a portion of the cable extending between the anchored end and the drum is in tension, slippage between the drum surface and the clasped at least one portion of the cable is substantially impeded and the drum is rotationally displaceable for displacing the clasped at least one portion of the cable away from the second guide members.

BRIEF DESCRIPTION OF THE DRAWINGS

An embodiment of the invention is described hereinafter with reference to the following drawings, in which:

FIG. 3*c* shows a side view of a second configuration of the hoist of FIG. 3*a*, wherein a plurality of cables are wound round the drum.

DETAILED DESCRIPTION

Figure 1:
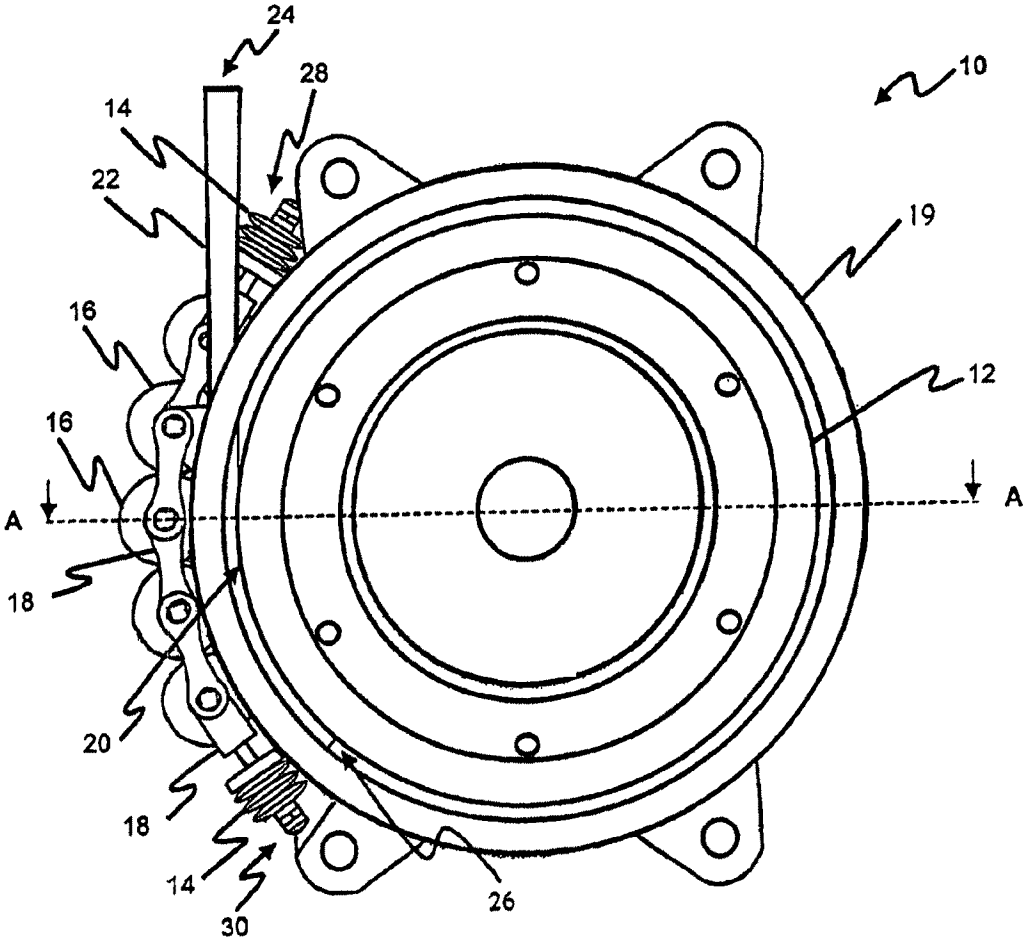
FIG. 1 shows a front elevation of a hoist according to an embodiment of the invention.

A hoist for hoisting a load by means of a cable is described hereinafter for addressing at least one of the aforementioned problems.

For purposes of brevity and clarity, the description of the invention is limited hereinafter to applications relating to hoists. This however does not preclude various embodiments of the invention from other applications. The fundamental concepts of the embodiments of the invention shall remain common throughout the various embodiments.

A first embodiment of the invention described in the detailed description provided hereinafter is in accordance with FIG. 1 to FIG. 2 of the drawings, in which like elements are numbered with like reference numerals.

Figure 2:
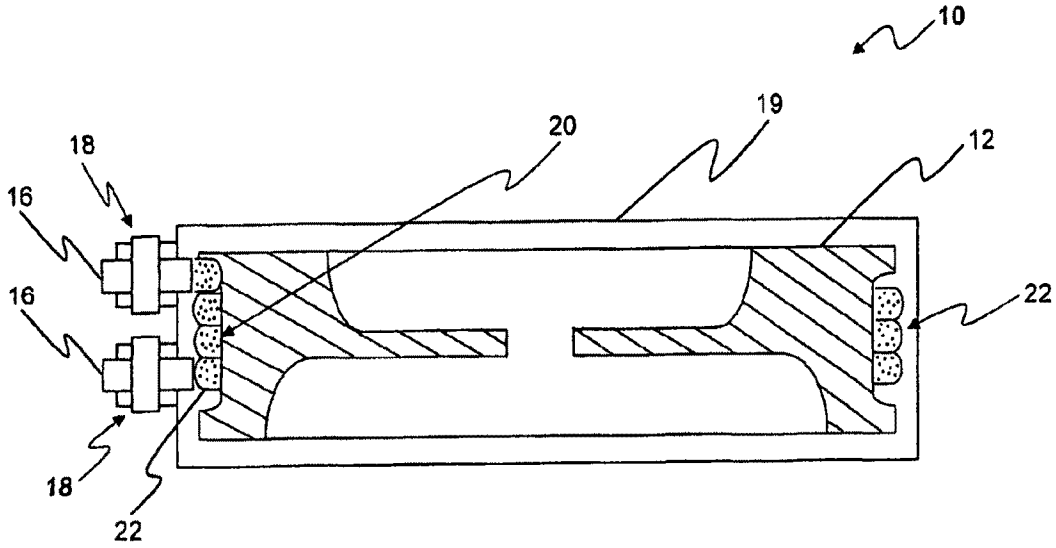
FIG. 2 shows a cross sectional view of the hoist of FIG. 1 along line A-A.

With reference to FIG. 1 and FIG. 2, a hoist 10 is described according to the first embodiment of the invention. The hoist 10 generally comprises a drum 12, a biasing device 14, a plurality of guides 16, a guide support 18 and a housing 19. The biasing device 14 and the guide support 18 form a biasing mechanism. The hoist 10 further comprises an actuator (not shown) operable for controlling rotational displacement of the drum 12. The actuator is preferably an electric motor. Alternatively, the actuator comprises a crank assembly operable for rotationally displacing the drum 12. The drum 12 comprises a drum surface 20 for supporting a cable 22, such as a rope, with the cable 22 having an anchored end 24 and a free end 26. Preferably, the cable 22 is wound around the drum 12 three times, as shown in FIG. 2. However, the cable 22 can be wound around the drum 12 more than three times. Alternatively, the cable 22 is wound around the drum 12 only once. Preferably, the drum surface 20 is substantially cylindrical. Alternatively, the drum surface 20 is substantially hyperbolical.

Furthermore, the drum 12 preferably comprises a groove (not shown) formed on the drum surface 20 that spirals a number of times around the drum 12. The groove is for locating the cable 22 within the groove when the cable 22 is being wound around the drum 12. This is for impeding lateral slippage or travel of the cable 22 off the drum surface 20 when the drum 12 is rotationally displaced. Additionally, the groove is preferably coated with a layer of material for hardening the surface of the groove. The surface of the groove after coating is preferably smooth for reducing friction between the cable 22 and the groove, thus reducing wear and tear of the cable 22, when the drum 12 is rotationally displaced.

Alternatively, the groove formed on the drum surface 20 spirals only once around the drum 12 for locating the cable 22 within the groove. The cable 22 is thus wound around the drum 12 only once.

The guide support 18, such as a chain or roller chain, comprises a first end 28 and a second end 30, and is preferably elongated. The guide support 18 is for inter-coupling the guides 16. Preferably, each of the guides 16 is a roller being rotatably coupled to the guide support 18.

The guide support 18 is further coupled to the biasing device 14. The biasing device 14 is preferably an assembly of one or more springs made from a coil of wire or elastic materials such as polyurethane. The biasing device 14 is coupled to the guide support 18 at the first end 28 and the second end 30 for biasing the first end 28 away from the second end 30. The biasing mechanism is coupled to and supported by the housing 19, which is coupled to the drum 12. Alternatively, the housing 19 is coupled to a frame (not shown) instead of the drum 12. Operatively, the biasing device 14 is for cooperating with the guide support 18 for biasing the guides 16 towards the drum 12 for clasping a portion of the cable 22 between the guides 16 and the drum 12. This is to substantially adhere the clasped portion of the cable 22 to the drum surface 20.

Additionally, more than one portion of the cable 22 is claspable between the guides 16 and the drum 12. To clasp more than one portion of the cable 22, more than one biasing device 14 and one guide support 18 are needed. As illustrated in FIG. 2 where the cable 22 is wound around the drum 12 three times, preferably two portions of the cable 22 are being substantially adhered to the drum surface 20 in which each of the two portions of the cable 22 is being clasped by one biasing device 14 together with one guide support 18. In particular, one of the two clasped portions is a part of the first wind of the cable 22 around the drum 12 and the other of the two clasped portions is a part of the last wind of the cable 22 around the drum 12. This is to ensure that the free end 26 of the cable 22 continues to wind around a portion of the drum 12 after the free end 26 travels across the guides 16 during rotational displacement of the drum 12.

Preferably, the biasing mechanism comprises the biasing device 14 and the guide support 18 for biasing the guides 16 towards the drum 12. Alternatively, another type of biasing mechanism comprising a plurality of biasing arms such as lever arms (not shown) can be provided for biasing the guides 16 towards the drum 12. Each of the guides 16 is coupled to each of the biasing arms and each of the biasing arms is for biasing each of the guides towards the drum 12.

A hoist (not shown) according to a second embodiment of the invention comprises the drum 12, the biasing device 14, the guide support 18 and the housing 19, in which the biasing device 14 and the guide support 18 form a biasing mechanism, as in the hoist 10 of FIG. 1 and FIG. 2 with the exception that this hoist comprises a single guide 16 instead of the plurality of guides 16. Furthermore, as there is only one guide 16 being coupled to the guide support 18, the guide support 18 is only for cooperating with the biasing device 14 for biasing the guide 16 towards the drum 12.

Alternatively, instead of providing the biasing mechanism comprising the biasing device 14 and guide support 18 for biasing the guide 16 towards the drum 12, another type of biasing mechanism comprising a biasing arm (not shown) for coupling the guide 16 thereto, is provided for biasing the guide 16 towards the drum 12.

Additionally, it is known in the art that besides the biasing mechanism described in each of the first and second embodiments of the invention, other types of biasing mechanism for biasing the guides 16 towards the drum 12 are implementable. Further, the preferred embodiment of the invention is the hoist 10 as described according to the first embodiment of the invention, which comprises the guides 16 and the type of biasing mechanism that comprises the biasing device 14 and the guide support 18.

Referring back to FIG. 1 and FIG. 2, when the hoist 10 is in use for hoisting a load (not shown), the portion of the cable 22 extending between the anchored end 24 and the drum 12, as well as the portion of the cable 22 wound into the groove are in tension. Consequently, slippage between the drum surface 20 and the two clasped portions of the cable 22 is substantially impeded. Further, the drum 12 is rotationally displaceable for displacing the two clasped portions of the cable 22 away from the guides 16. The guides 16 which are biased onto the cable 22 apply sufficient force thereto for adhering the cable 22 to the drum surface 20 without impeding travel of the cable 22 across the guides 16 when the drum 12 is rotationally displaced to thereby hoist the load. Further, the free end 26 of the cable 22 can be collected using a wheeler (not shown) as the drum 12 is being rotationally displaced.

Figure 3A:
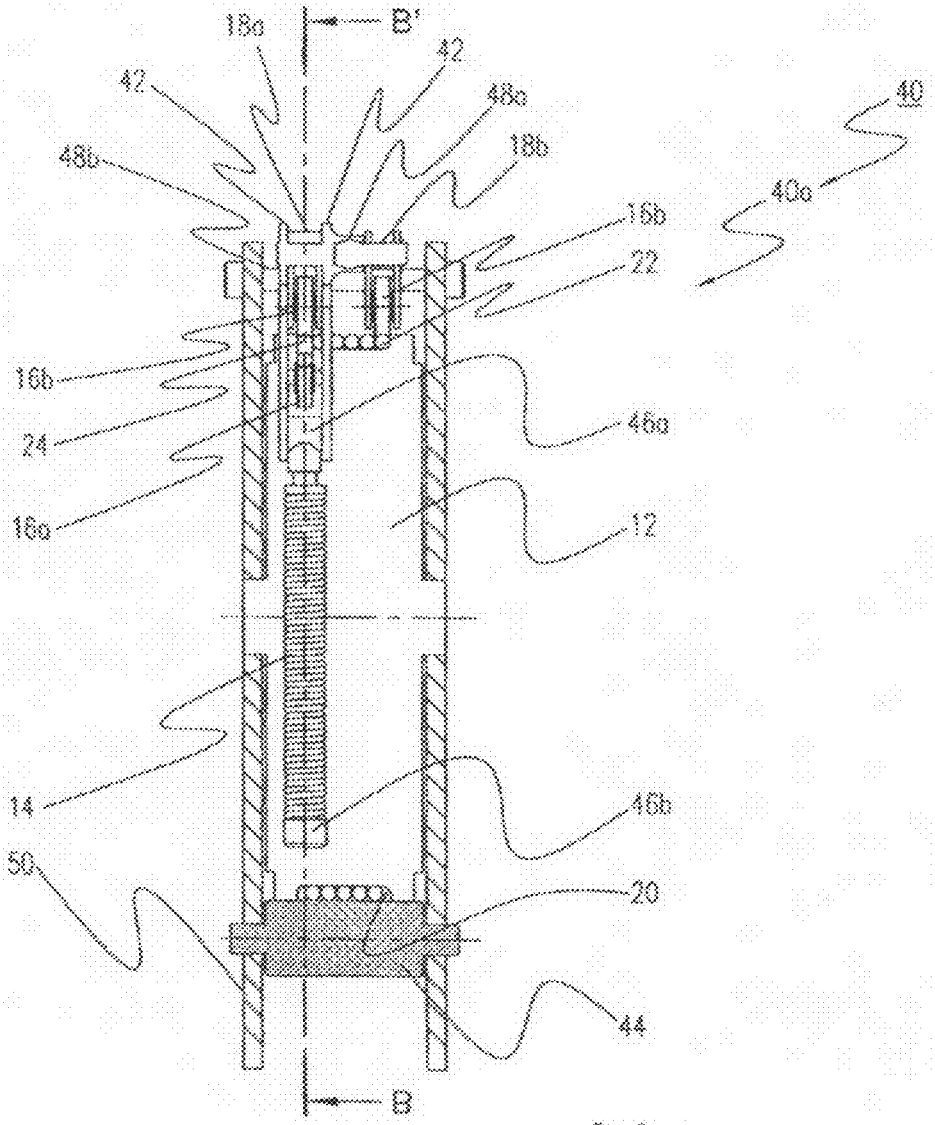
FIG. 3*a* shows a side view of a first configuration of a hoist in accordance with another embodiment of the invention, the first configuration comprises a drum, a biasing device, a plurality of guides, a plurality of the guide support and a lever member.
Figure 3B:
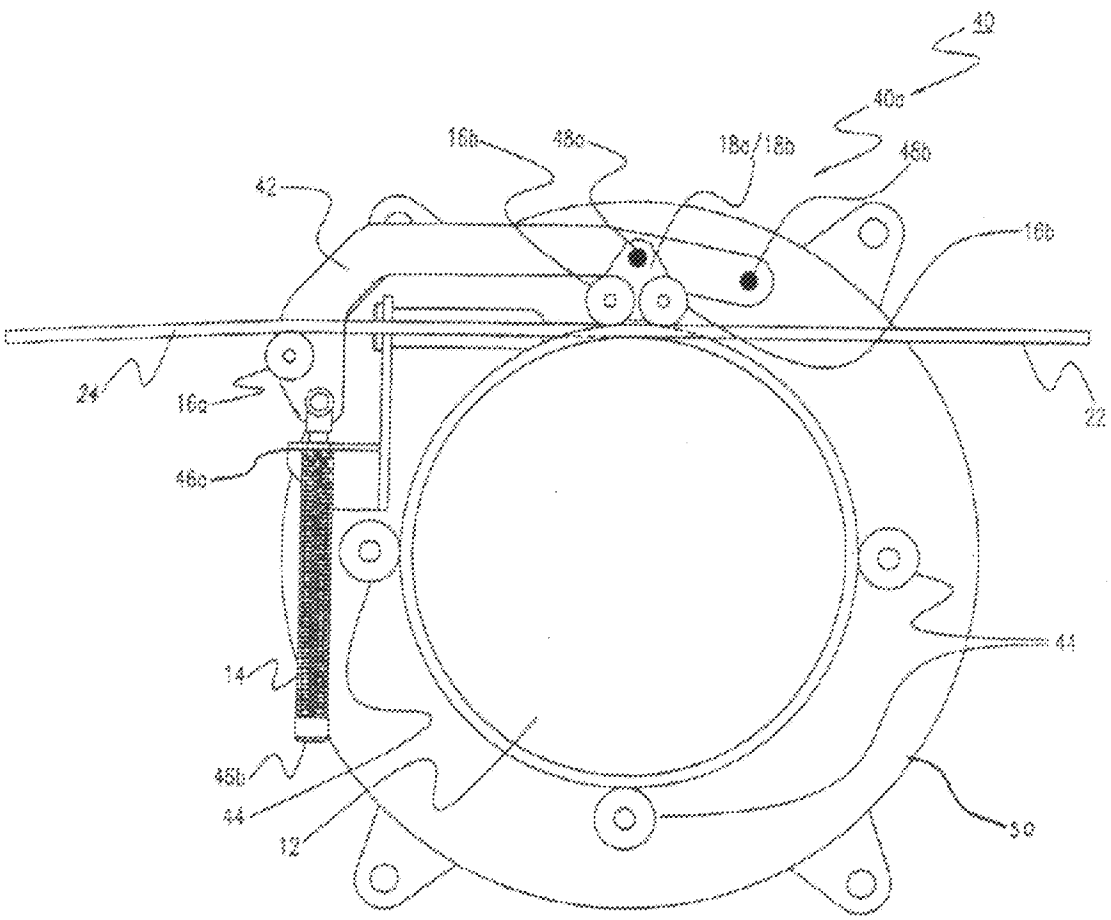
FIG. 3*b* shows a cross sectional view of the hoist of FIG. 3*a* along line B-B'.
Figure 2C:
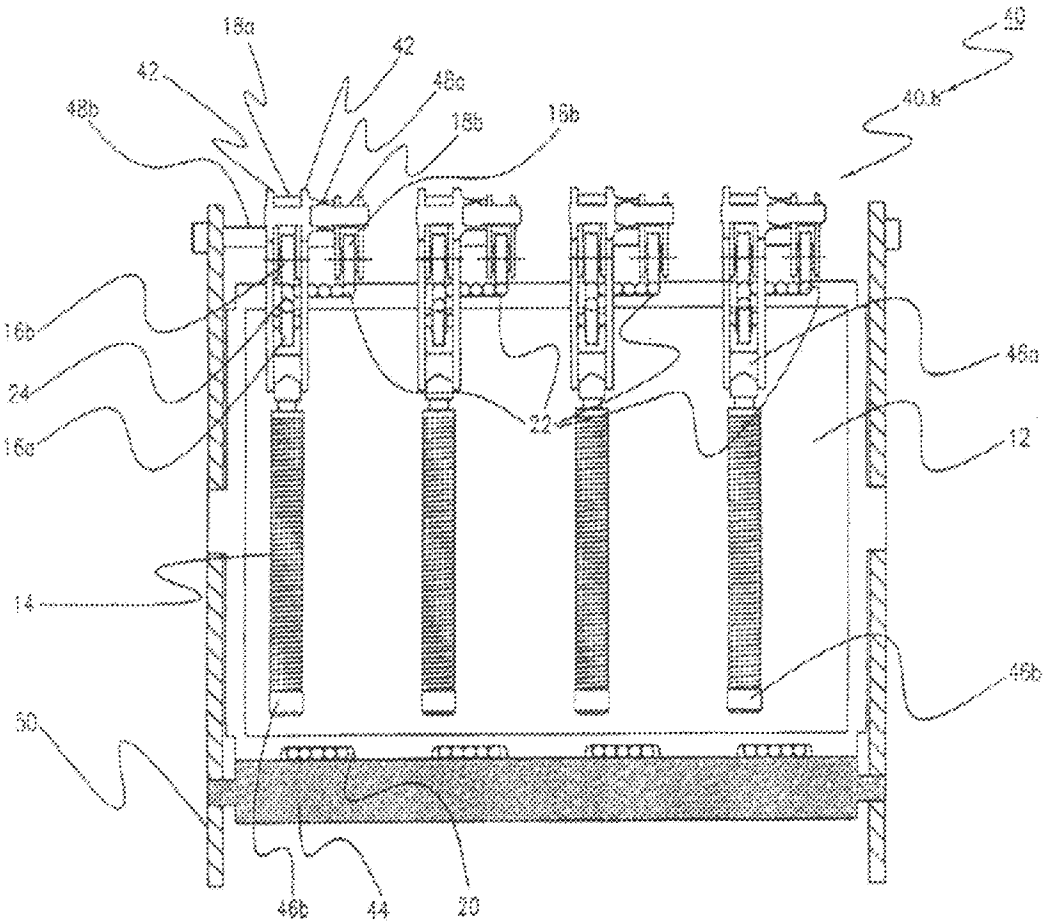

A hoist 40 according to a third embodiment of the invention is shown in FIG. 3*a*, FIG. 3*b* and FIG. 3*c*. The hoist 40 is preferably implemented in a first configuration 40*a* as shown in FIG. 3*a* and a second configuration 40*b* as shown in FIG. 3*c*.

FIG. 3*a* provides a side view of the first configuration 40*a* of the hoist 40 and FIG. 3*b* provides a cross sectional view of the first configuration 40*a* of the hoist 40 along line B-B'. FIG. 3*c* provides a side view of the second configuration 40*b* of the hoist 40.

Referring to FIG. 3*a*, the first configuration 40*a* comprises the drum 12, the plurality of guides 16, a plurality of the guide support 18 and a lever member 42. The plurality of guides 16 preferably comprise a first guide member 16*a* and second guide members 16*b*. The plurality of the guide support 18 preferably comprise at least a first guide support member 18*a* and a second guide support member 18*b*. The first configuration 40*a* further comprises the biasing device 14, one or more pressure rollers 44, a first stopper member 46*a* and a second stopper member 46*b*. Each of the first and second guide support members 18*a*/18*b* inter-couples the second guide members 16*b*.

The first and second guide support members 18*a*/18*b* and the lever member 42 are preferably inter-coupled by a first coupling member 48*a*. The lever member 42 is preferably further coupled, by a second coupling member 48*b*, to a common structure 50. The second coupling member 48*b* is preferably a pivot point about which the lever member 42 pivots. Preferably, the first stopper member 46*a* is also coupled to the common structure 50.

The pressure rollers 44 are coupled to the drum 12, along its periphery. Each of the pressure rollers 44 is preferably individually coupled to the periphery of the drum 12. Alternatively, each of the pressure rollers 44 is inter-coupled to another to form a pressure roller unit (not shown) prior to being coupled along the periphery of the drum 12. Each of the pressure rollers 42 are inter-coupled to each other by, for example, a chain or roller chain. In one variation, each of the pressure rollers 44 has a substantially smooth surface. In another variation, each of the pressure rollers 44 comprises a plurality of grooves (not shown) such that each of the pressure rollers 44 has a grooved surface.

The second guide members 16*b* are rotatable and a portion of the cable 22 is clasped between the second guide members 16*b* and the drum 12. The clasped portion of the cable 22 is substantially adhered to the drum surface 20. In an event where the clasped portion of the cable 22 is not fully adhered to the drum surface 20, the pressure rollers 44 serve to further adhere the clasped portion of the cable 22 to the drum surface 20.

In one example, the first and second guide support members 18*a*/18*b* and the lever member 42 form a biasing mechanism. In another example, the biasing device 14, the first and second guide support members 18*a*/18*b*, the lever member 42 and the first and second stopper members 46*a*/46*b* form a biasing mechanism. The biasing device 14 is, for example, a spring member and tension is provided by the biasing mechanism upon the biasing device 14 being compressed.

In a first exemplary operation where the biasing mechanism comprises the first and second guide support members 18*a*/18*b* and the lever member 42, the second guide members 16*b* are biased toward the drum surface 20 of the drum 12, prior to introduction of the cable 22 to the drum 12 by, for example, gravity. In this instance the biasing mechanism is substantially tensionless.

Upon introduction of the cable 22 to the drum 12 via the first guide member 16*a*, the lever member 42 pivots about the second coupling member 48*b*. The cable 22 is preferably introduced via the first guide member 16*a* such that the cable 22 presses against the first guide member 16*a*. As the cable 22 presses against the first guide member 16*a*, the second guide members 16*b* are further biased toward the drum surface 20 of the drum 12.

The cable 22 can be pressed against the first guide member 16*a* by, for example, loading and biasing the cable 22 towards the first guide member 16*a* via a pulley (not shown).

The cable 22 contacts the second guide members 16*b* so that the second guide members 16*b* are displaced away from the drum surface 20 of the drum 12. Therefore tension is provided by the biasing mechanism, further adhering the clasped portion of the cable 22 to the drum surface 20.

In a second exemplary operation where the biasing mechanism of the first exemplary operation further comprises the biasing device 14 and the first and second stopper members 46*a*/46*b*, the second stopper member 46*b* is moved towards the first stopper member 46*a* as the lever member 42 is pivoted such that the second guide members 16*b* are displaced away from the drum surface 20 of the drum 12. The biasing device 14 is consequently compressed between the first and second stopper members 46*a*/46*b*. As the basing device 14 is compressed, tension is provided by the biasing mechanism.

As mentioned earlier, the tension provided serves to further adhere the clasped portion of the cable 22 to the drum surface 20. Apparent from the above, the second guide members 16*b* can function as a fulcrum for the lever member 42. The amount of tension provided is controllable by adjusting displacement of the fulcrum and the second coupling member 48*b*.

FIG. 3*c* provides a side view of the second configuration 40*b*. As shown, a plurality of cables 22 are wound round the drum surface 20. Tension is applied to each of the plurality of cables 22 as described in the exemplary operations of the first configuration 40*a*.

Each of the hoist 10 and the hoist 40 is implementable in several ways with three exemplary configurations described hereinafter for hoisting the load (all not shown). In each of the exemplary configurations, the load is a gondola suspendable and positionable along a face of a fixed structure such as a building. The exemplary configurations are described hereinafter with respect to the hoist 10. It can be appreciated that the hoist 40 can also be implemented similarly to the hoist 10.

In a first exemplary configuration for implementing the hoist 10, the anchored end 24 is anchored to the top of a structure, for example a building, with the hoist 10 being mounted to the gondola.

In a second exemplary configuration for implementing the hoist 10, the anchored end 24 is anchored to the gondola with the hoist 10 being mounted to the top of the building.

In a third exemplary configuration for implementing the hoist 10, both the anchored end 24 and the hoist 10 are respectively anchored and mounted to the top of the building. The portion of the cable 22 extending between the anchored end 24 and the drum 12 forms a loop with a pulley being mounted to a portion thereof. The pulley is mounted to the gondola for connecting the gondola with the hoist 10 by means of the cable 22.

In each of the three exemplary configurations, when the hoist 10 is in operation, the gondola is positionable along the face of the building for lifting or lowering objects or individuals contained in the gondola.

In the foregoing manner, a hoist for hoisting a load is described according to embodiments of the invention for addressing at least one of the foregoing problems. Although only a few embodiments of the invention are disclosed, the invention is not to be limited to specific forms or arrangements of parts so described and it will be apparent to one skilled in the art in view of this disclosure that numerous changes and/or modification can be made without departing from the scope and spirit of the invention.

The invention claimed is:

1. A hoist comprising:

a rotatable drum having a drum surface for storing part of a cable in the form of multiple winds thereon in such way that the cable has a first free end and a second free end, each free end extending tangentially away from the drum surface and towards a direction opposite to each other, each wind of the multiple winds having at least a portion of the elongate side surface abutting to at least a portion of the elongate side surface of an adjacent wind;

a biasing mechanism located on the drum comprising a biasing device coupled to a guide support, wherein the biasing device comprises a spring member compressible between a first and a second stopper member for producing tension;

at least a pair of guides rotatably coupled to the guide support through a first coupling, the biasing mechanism for biasing the at least a pair of guides towards the drum surface in a fashion to have the at least a paired guides respectively clasping part of the first wind and the last wind of the multiple winds of the stored cable onto the drum surface; and a lever member coupling the at least one pair of guide members clasping onto a wind from which one of the free ends extends and the biasing device, the lever member for translating displacement of the at least one pair of guide members away from the drum surface by the free end of the clasped wind being pulled away or towards the drum surface into displacement of the first and second stopper members toward each other, thereby compressing the biasing device for producing reciprocating constant tension acting against displacement of the at least one pair guide members away from the drum surface, wherein each of the free ends is anchorable to a body independent of the hoist and/or a load and the first and second free ends are respectively originated from the first and last winds.

2. The hoist as in claim 1, further comprising:

an actuator, the drum being coupled to the actuator and the actuator being operable for controlling rotational displacement of the drum.

3. The hoist as in claim 1, further comprising a rotatable first guide on the lever member arranged to have part of the periphery of the first guide in tangential contact with a portion of the first free end passing thereby that displacement of the first guide by pulling the passing free end towards the drum surface is translated into displacement of the first and second stopper members toward each other by the lever member, thereby compressing the biasing device for producing reciprocating constant tension acting against displacement of the at least one pair guide members away from the drum surface.

4. The hoist as in claim 3, wherein the generated tension is adjustable through the first coupling.

5. The hoist as in claim 1, further comprising one or more pressure rollers coupled along and across periphery of the drum surface to clasp the stored cable to the drum surface.

6. The hoist as in claim 1, further comprising:

a housing for supporting the biasing mechanism, the housing being couplable to the drum.

7. The hoist as in claim 1, further comprising more than one pressure rollers coupled along and across periphery of the drum surface to clasp the stored cable to the drum surface and the pressure rollers interconnected to form a pressure roller unit at least partly encircling the drum surface around the rotating axis of the drum.

8. The hoist as in claim 1, the guide support being one of a chain and a roller chain.

9. The hoist as in claim 1, wherein the biasing device comprises a plurality of springs.

10. A hoist comprising:

a drum having a plurality of drum surfaces spaced apart from one another along the periphery of the drum that each spaced apart drum surface is configured to store an individual cable in the form of multiple winds thereon, each cable having two free ends, a first free end and a second free end, with each free end being enabled to extend tangentially away from the drum surface and towards a direction opposite to each other, each wind of the multiple winds having at least a portion of the elongate side surface abutting to at least a portion of the elongate side surface of an adjacent wind;

a plurality of biasing mechanism, each coupled to one drum surface comprising a biasing device coupled to a guide support through a first coupling the biasing device is a spring member compressible between a first and a second stopper members for producing tension;

at least a pair of guides rotatably coupled to the guide support of each biasing mechanism through a first coupling, the biasing mechanism for biasing the at least a pair of guides towards the coupled drum surface in a fashion to have the at least a paired guides respectively clasping part of the first wind and the last wind of the multiple winds of the stored cable onto the drum surface; and a plurality of lever members, each lever member coupled to the at least one pair of guide members clasping onto a wind from which one of the free ends extends and the biasing device of each biasing mechanism, the lever member for translating displacement of the at least one pair guide members away from the drum surface by one of the free ends being pulled away or towards the drum surface into displacement of the first and second stopper members toward each other, thereby compressing the biasing device for producing reciprocating constant tension acting against displacement of the at least one pair guide members away from the drum surface wherein each of the free ends from one of the drum surfaces is anchorable to a body independent of the hoist and/or a load and the first and second free ends are respectively originated from the first and last winds.

11. The hoist as in claim 10, further comprising:

an actuator, the drum being coupled to the actuator and the actuator being operable for controlling rotational displacement of the drum.

12. The hoist as in claim 10, further comprising a rotatable first guide on the lever member arranged in tangential contact with a portion of the first free end passing thereby such that displacement of the first guide by pulling the passing free end towards the drum surface is translated into displacement of the first and second stopper members toward each other by the lever member, thereby compressing the biasing device for producing constant tension acting against displacement of the at least one pair guide members away from the drum surface.

13. The hoist as in claim 12, wherein the generated tension is adjustable through the first coupling.

14. The hoist as in claim 10, further comprising:

a housing for supporting the biasing device and the guide support, the housing being couplable to the drum.

15. The hoist as in claim 10, further comprising one or more pressure rollers coupled along and across periphery of the drum to clasp the stored cable to the drum.

16. The hoist as in claim 15, further comprising more than one pressure rollers coupled along and across periphery of the drum to clasp the stored cable to the drum surface and the pressure rollers interconnected to form a pressure roller unit at least partly encircling the drum surface around the rotating axis of the drum.

17. A hoist comprising:

a rotatable drum having a first drum surface for storing part of a first cable in the form of at least four winds wounded thereon such that the stored first cable has a first leftmost wind with a first left free end and a first rightmost wind with a first right free end, each first free end extending tangentially away from the first drum surface and towards a direction opposite to each other, the first drum surface being defined between a first left drum periphery and a first right drum periphery such that the first leftmost wind is positioned next to the first left periphery and the first rightmost wind is positioned next to the first right periphery, each wind of the first cable stored on the drum surface having the elongate side surface abutting to the elongate side surface of an adjacent wind;

a first biasing mechanism located on the drum comprising a first biasing device coupled to a first guide support; and a pair of first guides rotatably coupled to the first guide support through a first coupling, the first biasing mechanism for biasing the pair of first guides towards the first drum surface in a fashion to have the pair of first guides respectively clasping part of the first leftmost wind and the first rightmost wind of the first cable of the stored cable onto the first drum surface;

wherein each of the first free ends is anchorable to a body independent of the hoist and/or a load.

18. The hoist of claim 17 further comprising:

a second drum surface located on the rotatable drum and downstream to the first drum surface to stored part of a second cable in the form of at least four winds wounded thereon such that the stored second cable has a second leftmost wind with a second left free end and a second rightmost wind with a second right free end, each second free end extending tangentially away from the second drum surface and towards a direction opposite to each other, the second drum surface being defined between a second left periphery and a second right periphery such that the second leftmost wind is positioned next to the second left periphery and the second rightmost wind is positioned next to the second right periphery, each wind of the second cable stored on the drum surface having the elongate side surface abutting to the elongate side surface of an adjacent wind;

a second biasing mechanism located on the drum comprising a second biasing device coupled to a second guide support; and a pair of second guides rotatably coupled to the second guide support through a second coupling, the second biasing mechanism for biasing the pair of second guides towards the second drum surface in a fashion to have the pair of second guides respectively clasping part of the second leftmost wind and the second rightmost wind of the second cable of the stored second cable onto the second drum surface, wherein each of the second free ends is anchorable to the body independent of the hoist and/or a load, and wherein the second cable is not the first cable.

19. The hoist of claim 17 further comprising a rotatable second coupled to the first biasing mechanism and being arranged to have part of the periphery of the first guide in tangential contact with a portion of the first right free end passing thereby that the first biasing mechanism translates displacement of the first guide into producing constant tension acting against displacement of the pair first guide members away from the first drum surface.

20. The hoist of claim 17 further comprising a first lever member coupling to the paired first guide members clasping onto the leftmost or rightmost wind which the first left or right free end extending from and the first biasing device which is a spring member compressible between two stopper members for producing tension, the first lever member being capable of translating displacement of the pair of first guide members away from the drum surface by the left or right free end being pulled away or towards the drum surface into displacement between the two stopper members toward each other, thereby compressing the first biasing device for producing reciprocating constant tension acting against displacement of the pair of first guide members away from the first drum surface.

* * * * *